US007669809B1

(12) United States Patent
Toner et al.

(10) Patent No.: US 7,669,809 B1
(45) Date of Patent: Mar. 2, 2010

(54) SADDLE LIFT APPARATUS

(76) Inventors: Terry Toner, 800 Hwy. 238, Jacksonville, OR (US) 97530; Lita West, P.O. Box 100, Carey, ID (US) 83320; John Toner, 4616 N. 199 Ave., Litchfield Park, AZ (US) 85340

( * ) Notice: Subject to any disclaimer, the term of this patent is extended or adjusted under 35 U.S.C. 154(b) by 404 days.

(21) Appl. No.: 11/712,045

(22) Filed: Feb. 27, 2007

(51) Int. Cl.
*A47F 5/02* (2006.01)
*A47F 7/00* (2006.01)
*A47F 5/00* (2006.01)
*A47G 23/02* (2006.01)

(52) U.S. Cl. ..... 248/130; 211/85.11; 248/150; 248/309.1

(58) Field of Classification Search ..... 248/130, 248/150, 309, 214, 291.1; 211/87.01, 85.11, 211/104, 18, 100, 99, 21, 96, 168, 194, 196, 211/205, 167, 189, 118, 113, 116; 54/84; D30/143
See application file for complete search history.

(56) References Cited

U.S. PATENT DOCUMENTS 3,294,267 A 12/1966 Schweigert
3,305,101 A * 2/1967 Mills ..... 211/106.01
3,476,255 A * 11/1969 Ciancio ..... 211/85.11
3,662,909 A 5/1972 Cherry
3,780,971 A * 12/1973 De Filipps ..... 248/309.1
3,811,574 A 5/1974 O'Brien
4,356,922 A * 11/1982 Dierksheide ..... 211/85.11
4,541,535 A 9/1985 Bartholomew
5,615,783 A * 4/1997 Warnken ..... 211/118
6,082,552 A * 7/2000 Pollock et al. ..... 211/18
6,955,270 B2 10/2005 Lay et al.
D522,186 S * 5/2006 Taylor ..... D30/143
7,500,573 B1 * 3/2009 Flynn ..... 211/85.11

* cited by examiner

*Primary Examiner*—Khoa D Huynh
*Assistant Examiner*—Christopher Garft
(74) *Attorney, Agent, or Firm*—Gerald D. Haynes; R. Keith Harrison

(57) ABSTRACT

A saddle lift apparatus is disclosed. An illustrative embodiment of the saddle lift apparatus includes a base, an arm support member extending from the base, a saddle support arm pivotally carried by the arm support member, a saddle lift actuating assembly engaging the saddle support arm and a plurality of saddle supports carried by the saddle support arm.

16 Claims, 8 Drawing Sheets

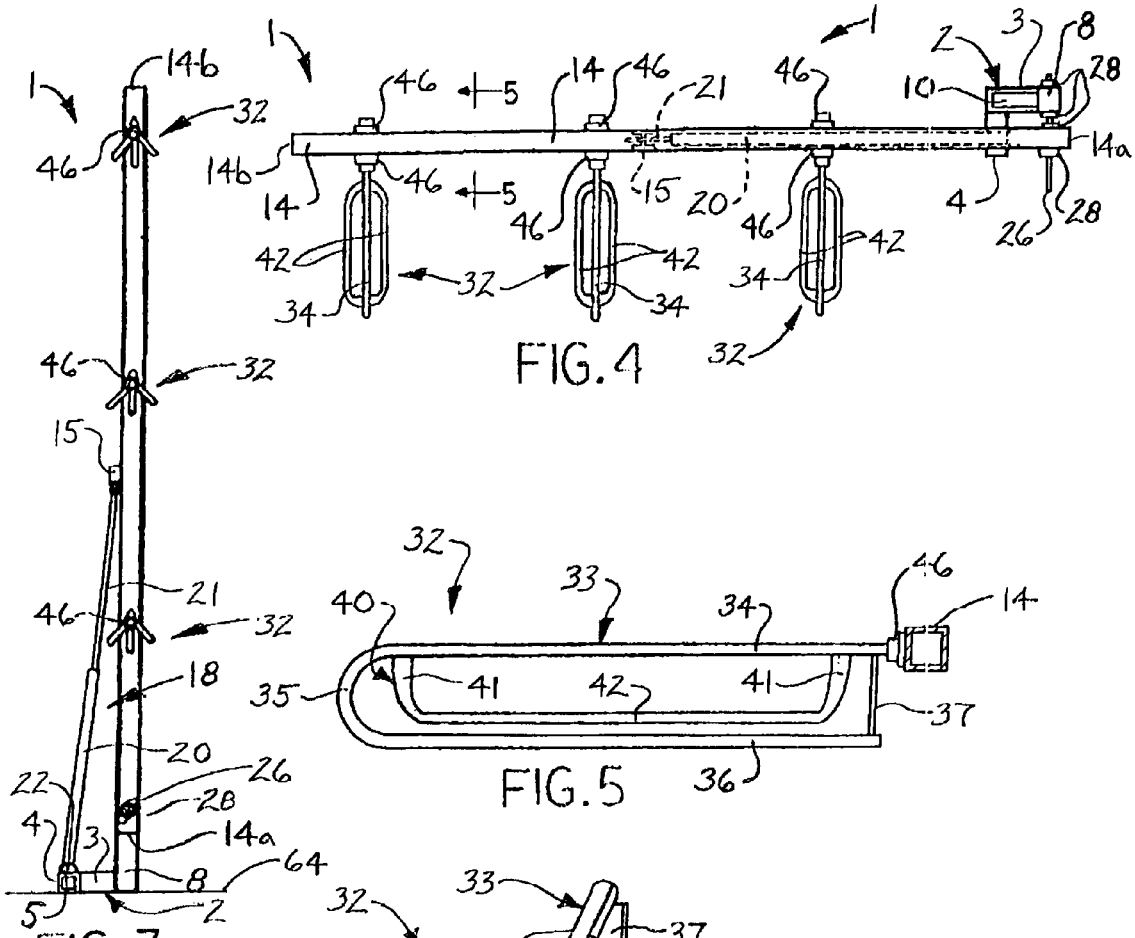
FIG. 3
FIG. 4
FIG. 5
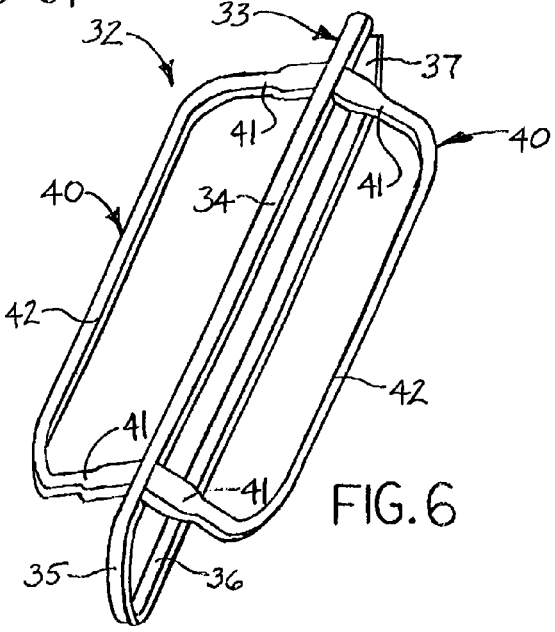
FIG. 6

SADDLE LIFT APPARATUS

FIELD

The present invention relates to apparatuses for lifting and storing horse saddles. More particularly, the present invention relates to a saddle lift apparatus for lifting and storing multiple horse saddles.

BACKGROUND

When not in use, horse saddles are typically stored on saddle supports which generally maintain the shape of the saddles. The simplest form of saddle support which is used for the storage of saddles is a horizontal wooden beam such as a two-by-four on which the saddle is placed. However, the saddle has a tendency to easily fall from the beam.

Horses are frequently transported for show and/or riding purposes. Therefore, horse saddles frequently require transportation with the horses. Commonly, horse saddles are placed on the floor of a horse trailer or the like for transportation. However, the lack of a user-friendly saddle storage system increases the risk of injury to persons attempting to move and store the saddles. In addition, lack of a suitable support for the saddle during transportation may cause the saddle to lose its optimum shape over time.

SUMMARY

The present invention is generally directed to a saddle lift apparatus. An illustrative embodiment of the saddle lift apparatus includes a base, an arm support member extending from the base, a saddle support arm pivotally carried by the arm support member, a saddle lift actuating assembly engaging the saddle support arm and a plurality of saddle supports carried by the saddle support arm.

BRIEF DESCRIPTION OF THE DRAWINGS

The invention will now be described, by way of example, with reference to the accompanying drawings, in which:

FIG. 3 a front view of an illustrative embodiment of the saddle lift apparatus, with multiple saddle supports of the apparatus illustrated in a raised, generally vertical storage configuration;

FIG. 4 is a top view of an illustrative embodiment of the saddle lift apparatus;

FIG. 5 is a sectional view, taken along section lines 5-5 in FIG. 4, of an illustrative embodiment of the saddle lift apparatus;

FIG. 6 is a perspective view of a saddle support element of an illustrative embodiment of the saddle lift apparatus;

DETAILED DESCRIPTION

Figure 1:
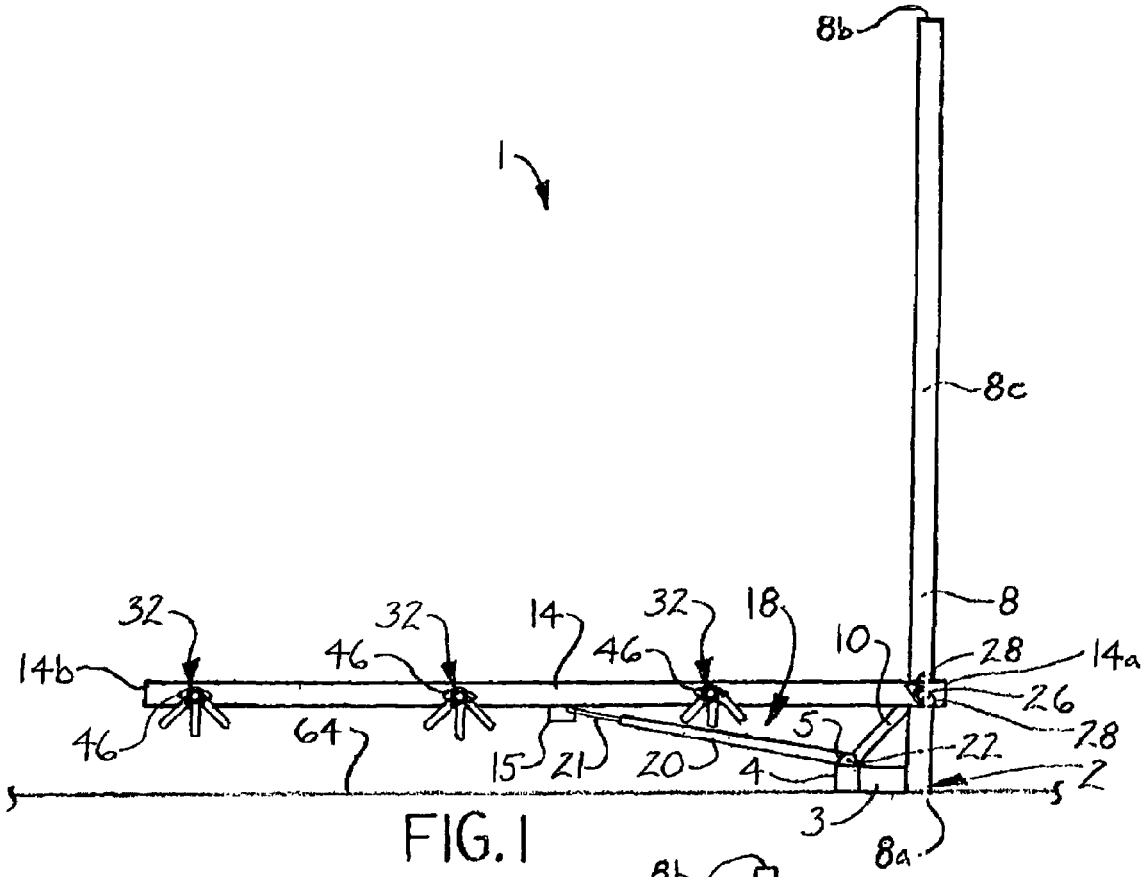
FIG. 1 is a front view of an illustrative embodiment of the saddle lift apparatus, with multiple saddle supports of the apparatus illustrated in a lowered, generally horizontal loading/unloading configuration.
Figure 2:
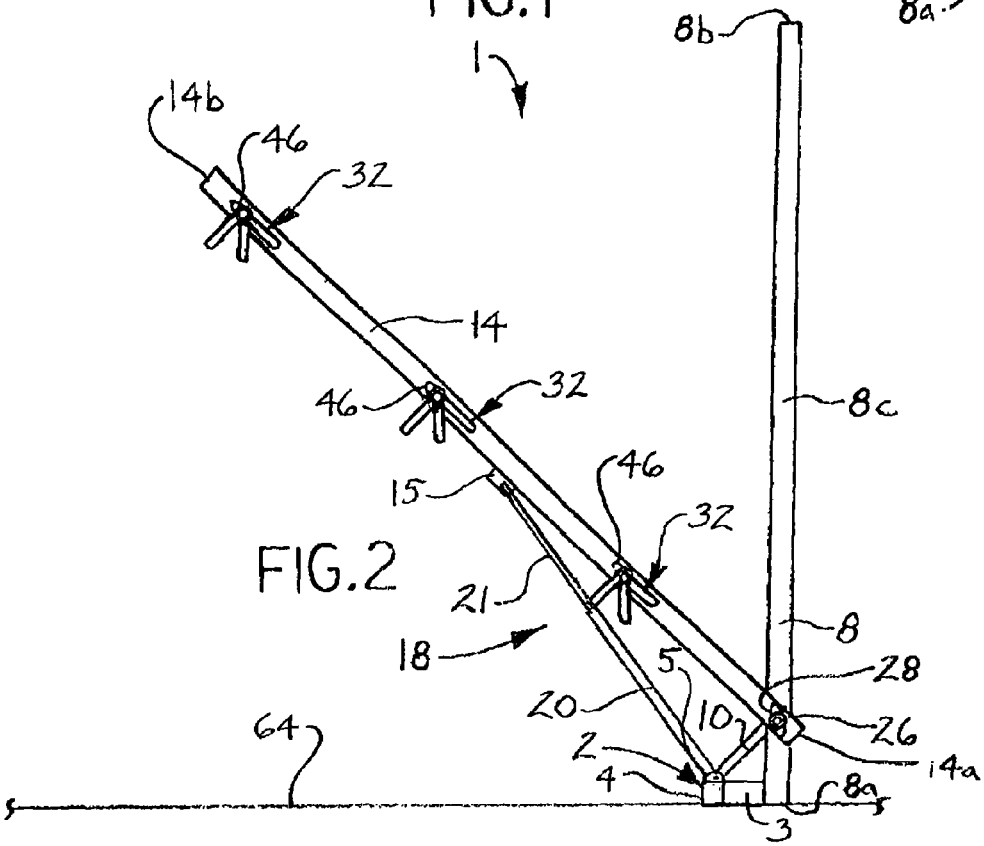
FIG. 2 is a front view of an illustrative embodiment of the saddle lift apparatus, with multiple saddle supports of the apparatus illustrated in a partially-raised configuration.

Referring initially to FIGS. 1-8 of the drawings, an illustrative embodiment of the saddle lift apparatus is generally indicated by reference numeral 1. The saddle lift apparatus 1 includes a base 2 which is adapted for support by a support surface 64. The support surface 64 may be, for example, a floor in a garage or other storage facility (not illustrated) or a floor in a horse trailer or other transport vehicle (not illustrated). The base 2 may be square tubing, for example, and typically includes a main base member 3 and a base extension member 4 which extends from and is disposed in generally perpendicular relationship with respect to the main base member 3, as shown in FIG. 4.

Figure 7:
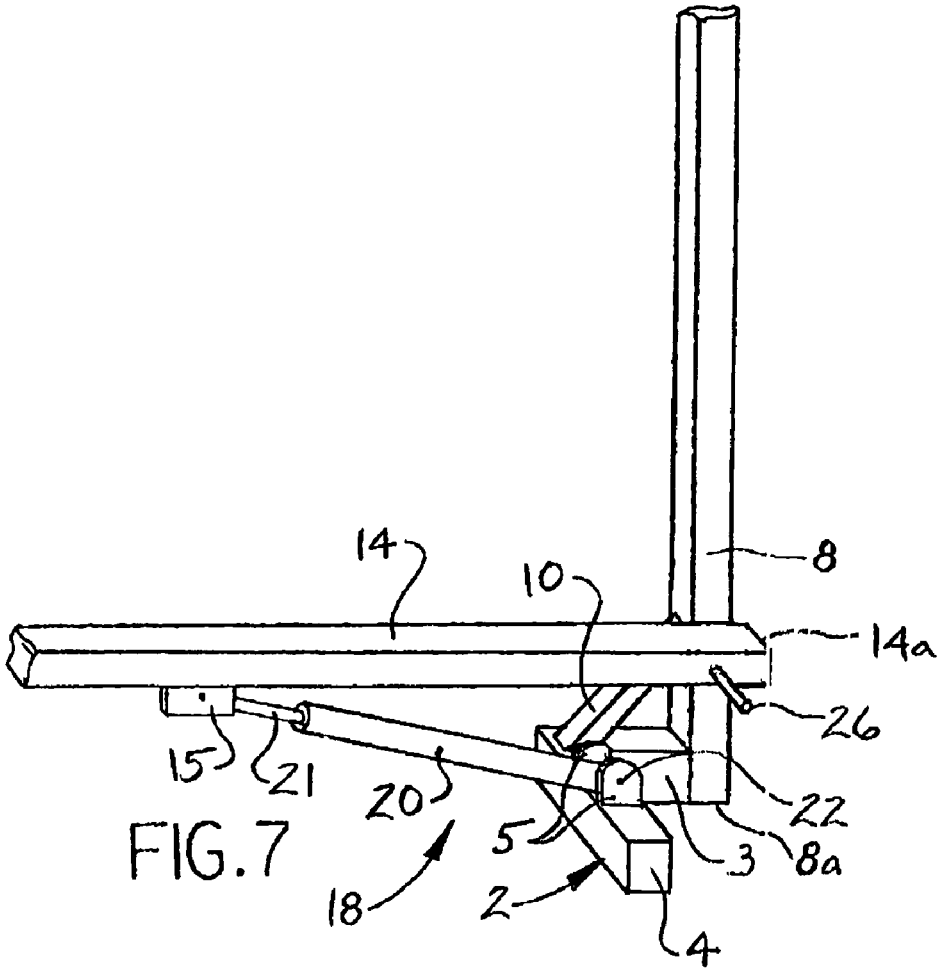
FIG. 7 is a perspective view, partially in section, of a saddle lift actuating assembly of an illustrative embodiment of the saddle lift apparatus.

An elongated arm support member 8, which may be square tubing, for example, extends from the main base member 3 of the base 2. The arm support member 8 has a proximal end 8*a*, a distal end 8*b* which is spaced-apart from the proximal end 8*a* and a midpoint 8*c* which is substantially midway between the proximal end 8*a* and the distal end 8*b*. The portion of the arm support member 8 which extends adjacent to the proximal end 8*a* is attached to the main base member 3 of the base 2 using fasteners, welding and/or alternative techniques known by those skilled in the art. As illustrated in FIG. 7, the arm support member 8 is disposed in generally perpendicular relationship with respect to each of the main base member 3 and the base extension member 4 of the base 2. A reinforcing member 10 may extend between the main base member 3 and the arm support member 8 for reinforcement purposes.

An elongated saddle support arm 14, which may be square tubing, for example, is pivotally attached to the arm support member 8. The saddle support arm 14 has a proximal end 14*a*, the corresponding end portion of which is pivotally attached to the arm support member 8 between the proximal end 8*a* and the midpoint 8*c* thereof, and a distal end 14*b* which is spaced-apart from the proximal end 14*a*. In some embodiments of the saddle lift apparatus 1, a pivot shaft 26 extends through registering shaft openings (not illustrated) provided in the arm support member 8 and the saddle support arm 14, respectively. As illustrated in FIG. 4, the pivot shaft 26 typically further extends through shaft bearings 28 which are provided on the arm support member 8 and the saddle support arm 14.

A saddle lift actuating assembly 18 operably engages the saddle support arm 14 to facilitate selective pivoting (raising and lowering) of the saddle support arm 14 with respect to the arm support member 8. Accordingly, the saddle lift actuating assembly 18 is capable of positioning the saddle support arm 14 between the lowered, generally horizontal loading/unloading configuration illustrated in FIG. 1 and the raised, generally vertical storage configuration illustrated in FIG. 3.

As illustrated in FIG. 7, in some embodiments of the saddle lift apparatus 1, the saddle lift actuating assembly 18 includes a cylinder 20. A piston 21 is extendable from and retractable into the cylinder 20. The cylinder 20 and extendable piston 21 may be pneumatic, hydraulic or electric and may have a conventional design which is known by those skilled in the art. A control mechanism (not illustrated) which facilitates selective extension of the piston 21 from the cylinder 20 and retraction of the piston 21 into the cylinder 20 may be provided on the base 2, the arm support member 8 or any other suitable element of the saddle lift apparatus 1. Alternatively, the control mechanism may function as a separate unit which is connected to the cylinder 20.

A pair of spaced-apart cylinder mount flanges 5 is provided on the base extension member 4 of the base 2, generally beneath the saddle support arm 14. The cylinder 20 is pivotally mounted between the cylinder mount flanges 5 via a pivot pin 22. A pair of spaced-apart piston attachment flanges 15 is provided on the saddle support arm 14, between the proximal end 14*a* and the distal end 14*b* thereof. The distal or extending end of the piston 21 is pivotally attached to the piston attachment flanges 15. Accordingly, by retraction of the piston 21 in the cylinder 20, the saddle support arm 14 is disposed in the lowered, generally horizontal loading/unloading configuration illustrated in FIG. 1. Conversely, by extension of the piston 21 from the cylinder 20, the saddle support arm 14 is lifted to the raised, generally vertical storage configuration illustrated in FIG. 3 for purposes which will be hereinafter described. It is to be understood that placement of the saddle lift actuating assembly 18 as was heretofore described is just one example of suitable placement of the saddle lift actuating assembly 18 and that the cylinder 20, piston 21 and other elements of the saddle lift actuating assembly 18 may be provided in alternative locations and configurations which are consistent with the function of pivoting the saddle support arm 14 with respect to the arm support member 8.

At least one saddle support 32 is provided on the saddle support arm 14. In some embodiments of the saddle lift apparatus 1, multiple saddle supports 32 are provided on the saddle support arm 14 in spaced-apart relationship with respect to each other, as shown in FIGS. 1-4. Each saddle support 32 may have any configuration which is suitable for supporting a horse saddle 50, as illustrated in phantom in FIG. 8. As illustrated in FIGS. 4-6, in some embodiments of the saddle lift apparatus 1, each saddle support 32 includes a saddle support frame 33 having an elongated saddle support shaft 34 which is rotatably attached to the saddle support arm 14 typically in a manner which will be hereinafter described. A bend segment 35 extends from the saddle support shaft 34. An elongated return segment 36 extends from the bend segment 35 in generally parallel, spaced-apart relationship with respect to the saddle support shaft 34. A connecting member 37 connects the return segment 36 to the saddle support shaft 34.

A pair of side support members 40 extends from the saddle support shaft 34 of the saddle support frame 33. Each side support member 40 has a generally U-shaped configuration and includes a pair of support member arms 41 which extend from the saddle support shaft 34 in spaced-apart relationship with respect to each other. An elongated connecting member 42 extends between the support member arms 41. A plane formed by the support arms 41 and connecting member 42 of each side support member 40 is disposed at a generally acute angle with respect to a plane formed by the saddle support shaft 34, bend segment 35 and return segment 36 of the saddle support frame 33.

The saddle support shaft 34 of each saddle support 32 is rotatably attached to the saddle support arm 14 using any suitable technique which is known by those skilled in the art. As illustrated in FIG. 4, in some embodiments of the saddle lift apparatus 1, the saddle support shaft 34 extends through a pair of shaft bearings 46 which register with shaft openings (not illustrated) extending through respective sides of the saddle support arm 14.

Figure 9:
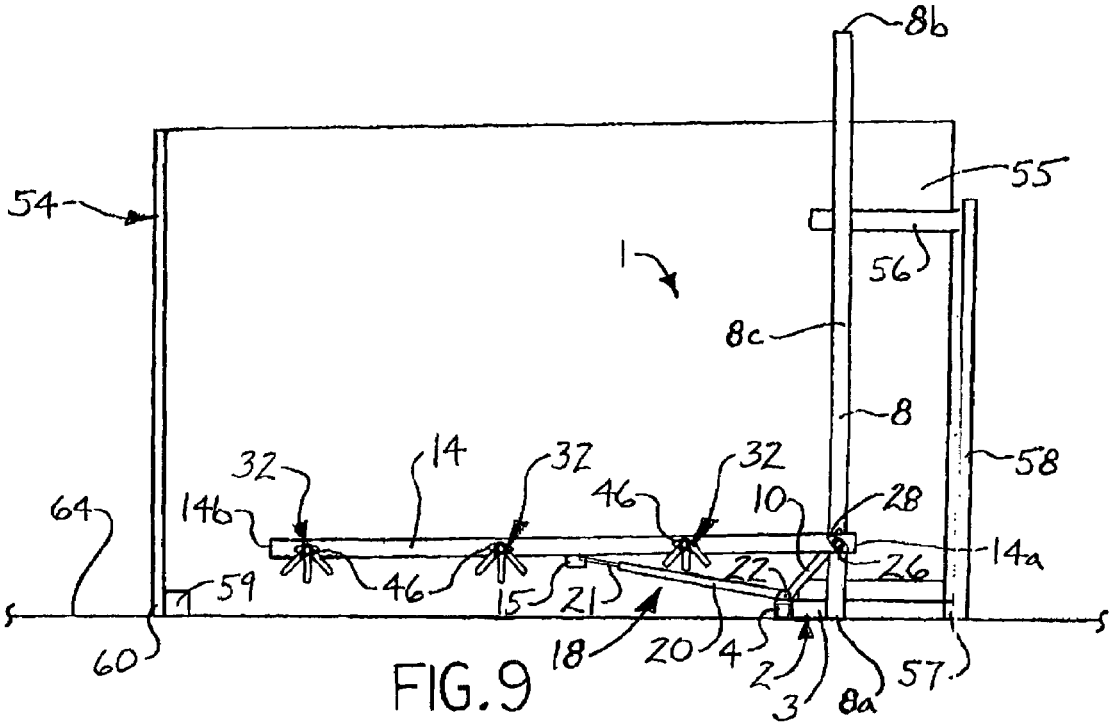
FIG. 9 is a front view of an illustrative embodiment of the saddle lift apparatus, reinforced by a support structure.
Figure 10:
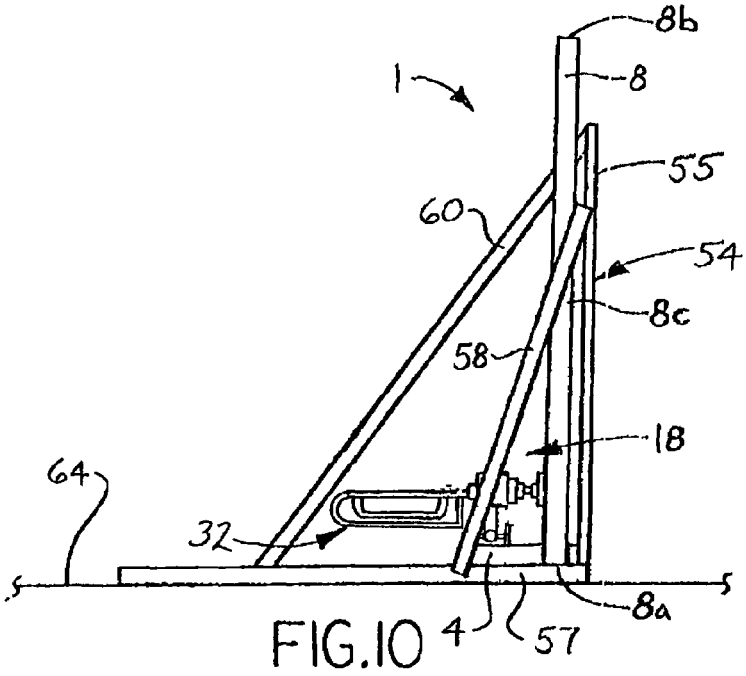
FIG. 10 is a left side view of an illustrative embodiment of the saddle lift apparatus, reinforced by a support structure.
Figure 11:
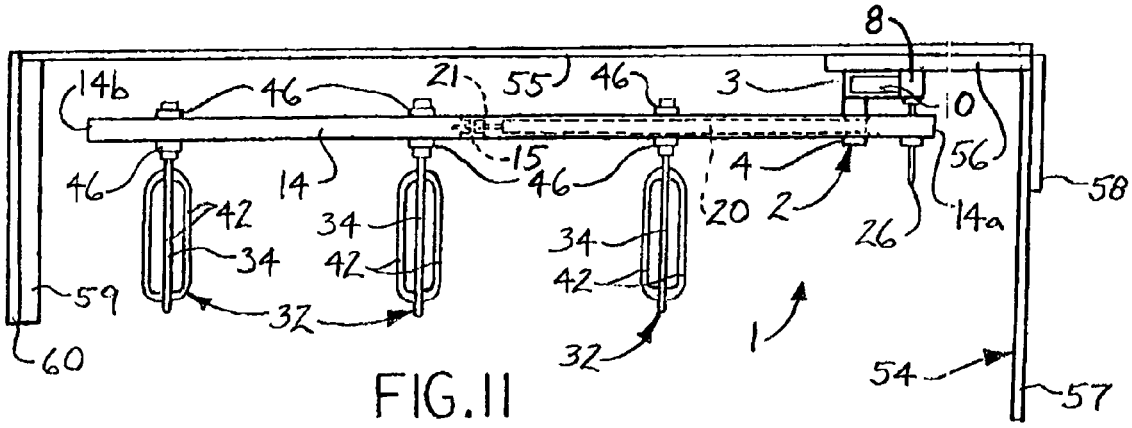
FIG. 11 is a top view of an illustrative embodiment of the saddle lift apparatus, reinforced by the support structure.

Referring next to FIGS. 9-11 of the drawings, in some embodiments the saddle lift apparatus 1 is stabilized by a support structure 54 which rests on a support surface 64 such as a floor in a garage or other storage facility, for example. The support structure 54 includes a generally elongated, rectangular support panel 55. An apparatus attachment member 56 is provided on a front surface of the support panel 55. The arm support member 8 of the saddle lift apparatus 1 is attached to the apparatus attachment member 56 using fasteners (not shown) and/or alternative fastening techniques known by those skilled in the art. A first elongated side support member 57 extends from a first edge of the support panel 55. As illustrated in FIG. 10, an angled side support brace 58 typically extends between the support panel 55 and the first side support member 57. A second elongated side support member 59 extends from a second edge of the support panel 55. An angled side support brace 60 (FIG. 10) typically extends between the support panel 55 and the second side support member 59. Accordingly, the support structure 54 supports and stabilizes the saddle lift apparatus 1 during operation, which will be hereinafter described.

Figure 8:
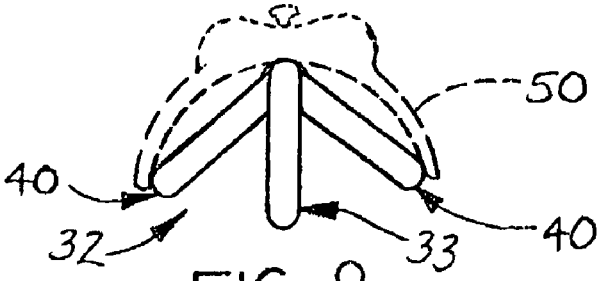
FIG. 8 is a front view of a saddle support element, with a horse saddle (shown in phantom) supported by the saddle support.
Figure 12:
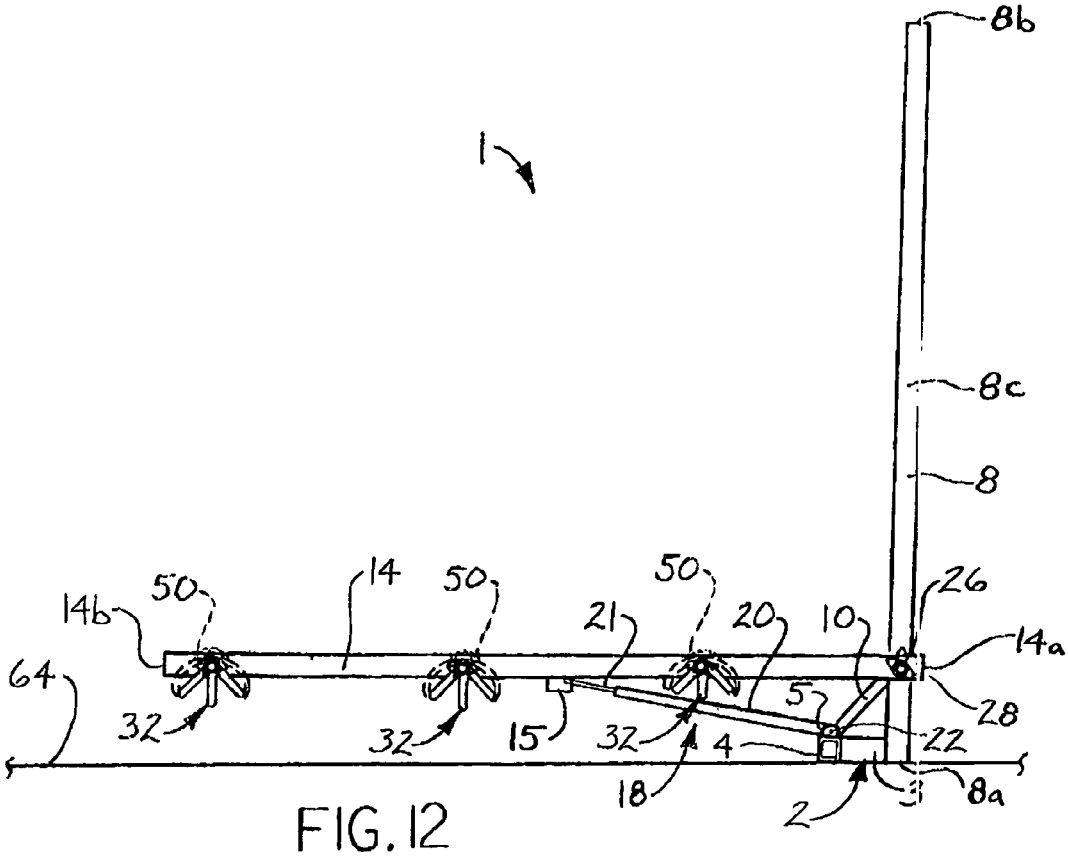
FIG. 12 is a front view of an illustrative embodiment of the saddle lift apparatus, with multiple saddle supports of the apparatus illustrated in a lowered, generally horizontal loading/unloading configuration and multiple horse saddles (shown in phantom) supported by the respective saddle supports.
Figure 13:
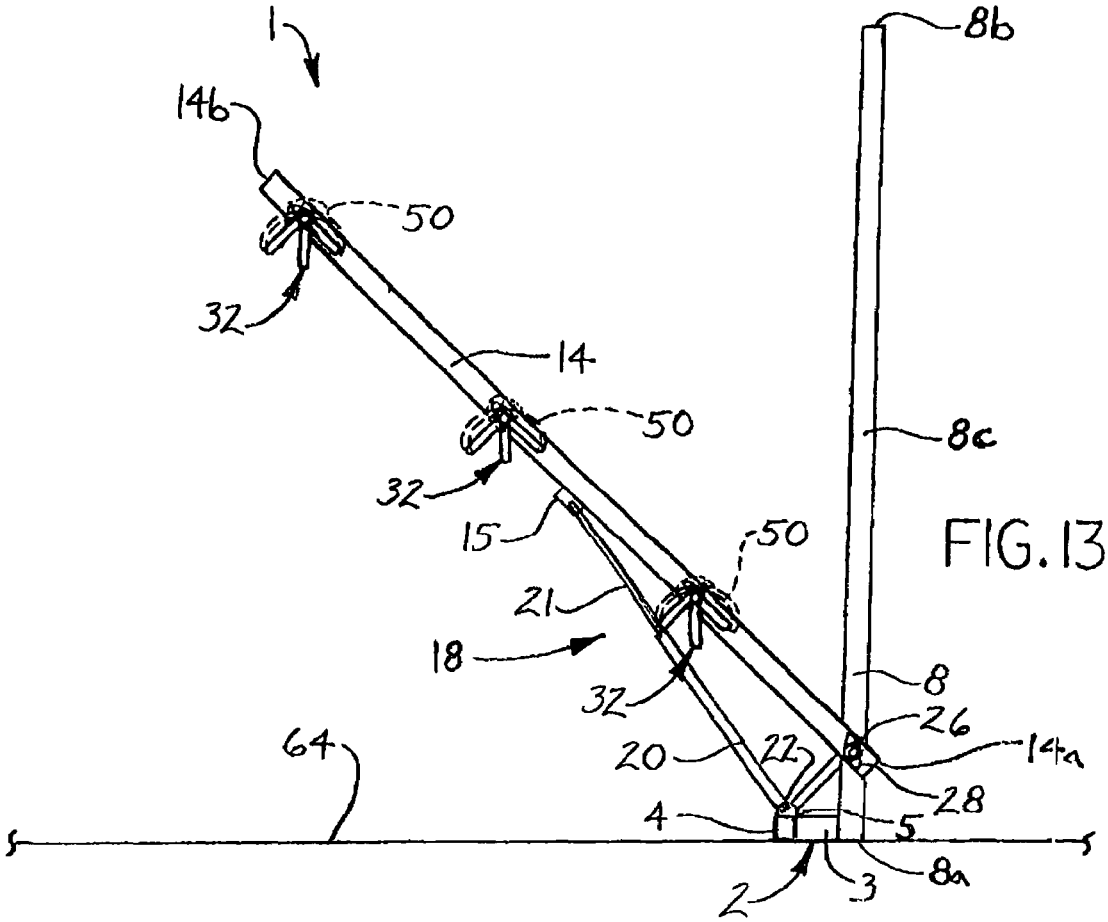
FIG. 13 is a front view of an illustrative embodiment of the saddle lift apparatus, with multiple saddle supports of the apparatus illustrated in a partially-raised configuration and multiple horse saddles (shown in phantom) supported by the respective saddle supports.
Figure 14:
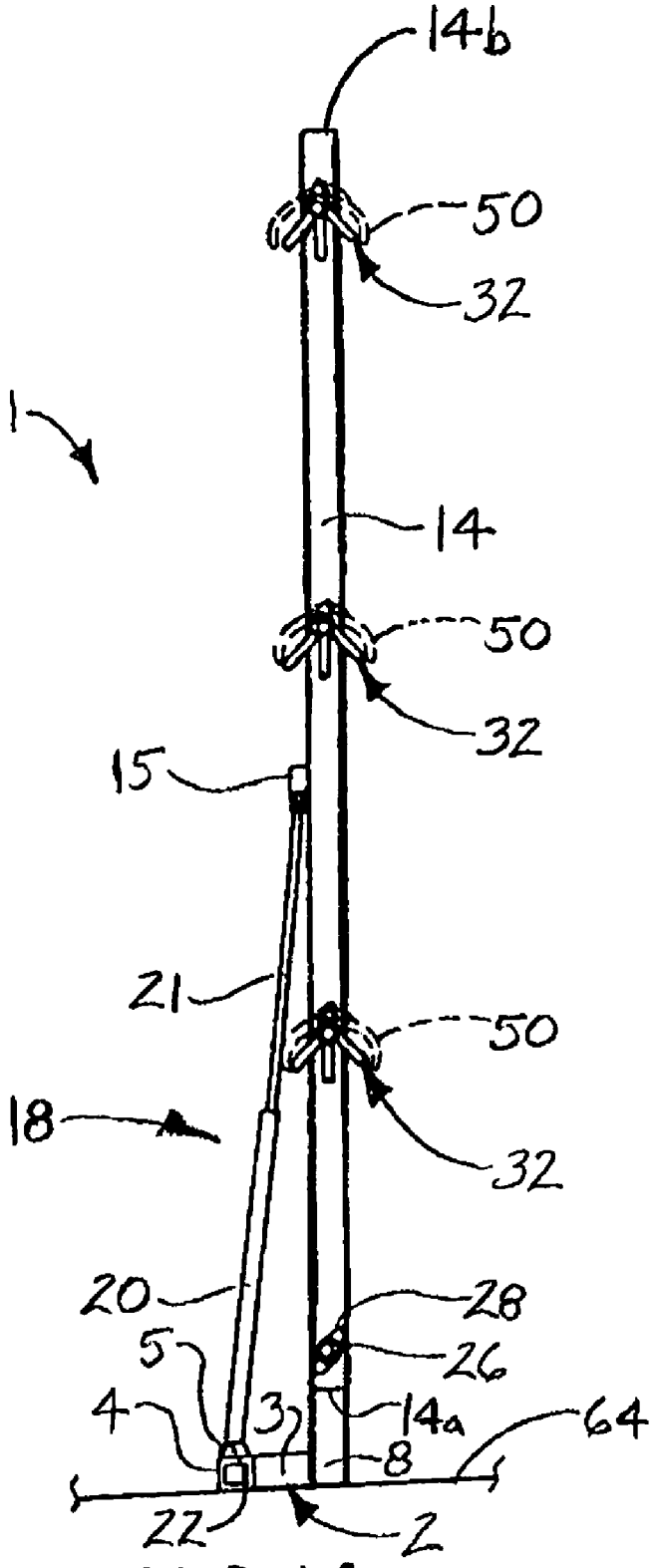
FIG. 14 a front view of an illustrative embodiment of the saddle lift apparatus, with multiple saddle supports of the apparatus illustrated in a raised, generally vertical storage configuration and multiple horse saddles (shown in phantom) supported by the respective saddle supports.

Referring next to FIGS. 8 and 12-14 of the drawings, in typical operation of the saddle lift apparatus 1, the saddle support arm 14 is initially positioned in the lowered, generally horizontal loading/unloading configuration illustrated in FIG. 12. At least one horse saddle 50 (shown in phantom) is placed on at least one of the saddle supports 32. Accordingly, as illustrated in FIG. 8, the saddle support frame 33 and the side support members 40 of each saddle support 32 support the horse saddle 50 in a spread, functional configuration to prevent mis-shapening of the saddle 50. The saddle lift actuating assembly 18 is then operated to extend the piston 21 from the cylinder 20 such that the saddle support arm 14 is pivoted from the lowered, generally horizontal loading/unloading configuration illustrated in FIG. 12 to the raised, generally vertical storage configuration illustrated in FIG. 14. It will be appreciated by those skilled in the art that each saddle support 32 rotates with respect to the corresponding shaft bearing 46 as the saddle support arm 14 is pivoted from the loading/unloading configuration illustrated in FIG. 12 to the storage configuration illustrated in FIG. 14, such that each saddle support 32, and the horse saddle 50 supported thereon, is maintained in a generally upright position throughout. In the storage position illustrated in FIG. 14, the horse saddles 50 are supported on the respective saddle supports 32 as the saddle lift actuating assembly 18 maintains the saddle support arm 14 in a generally vertical position. Thus, the generally vertical position of the saddle support arm 14 facilitates space-efficient storage of the horse saddles 50 when not in use. Furthermore, each saddle support 32 maintains the horse saddle 50 therein in a spread, functional position to maintain the functional position of the horse saddle 50 during storage. When use of the horse saddles 50 is desired, the saddle lift actuating assembly 18 is operated to retract the piston 21 back into the cylinder 20 such that the saddle support arm 14 is lowered from the upright storage position illustrated in FIG. 14 to the lowered, generally horizontal loading/unloading position illustrated in FIG. 12. Alternatively, a removable lock pin can be utilized to engage/disengage the saddle support arm 14 to provide a vertical loading/unloading position. The horse saddles 50 can then be removed from the respective saddle supports 32 for use.

Figure 15:
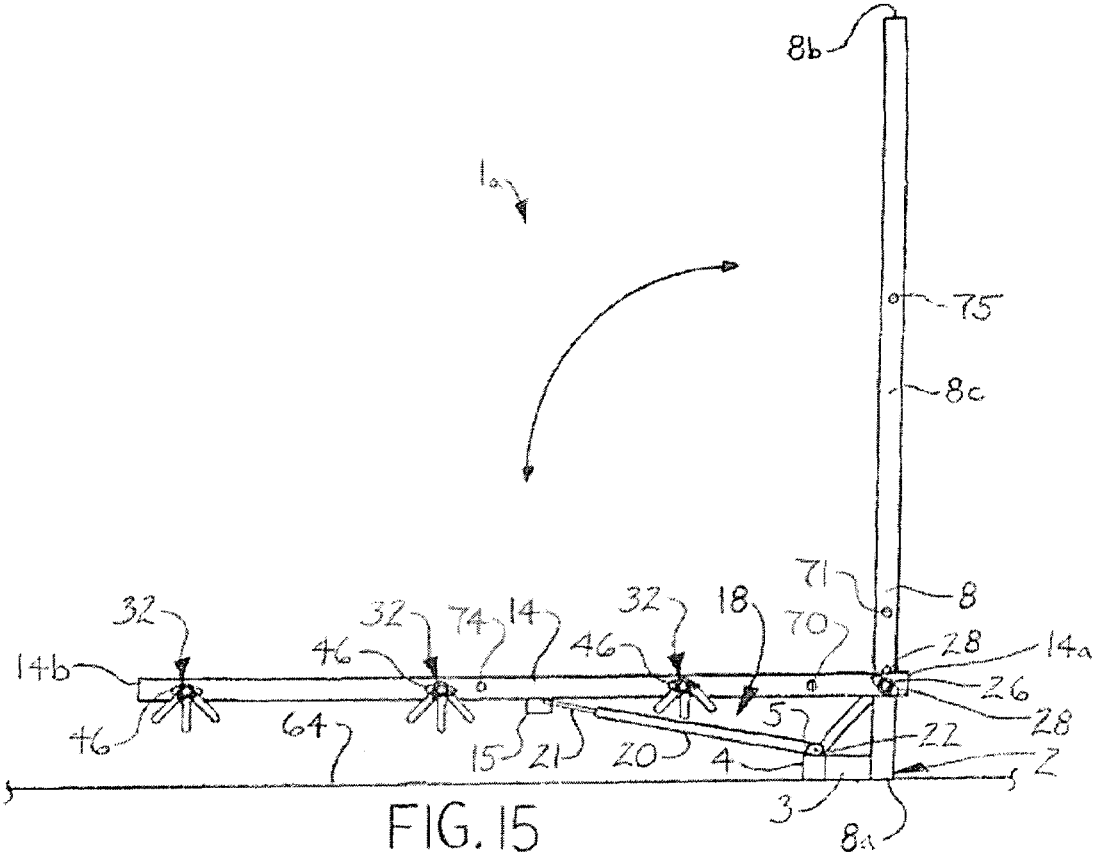
FIG. 15 is a front view of an alternative illustrative embodiment of the saddle lift apparatus, with multiple saddle supports of the apparatus illustrated in a lowered, generally horizontal loading/unloading configuration.
Figure 16:
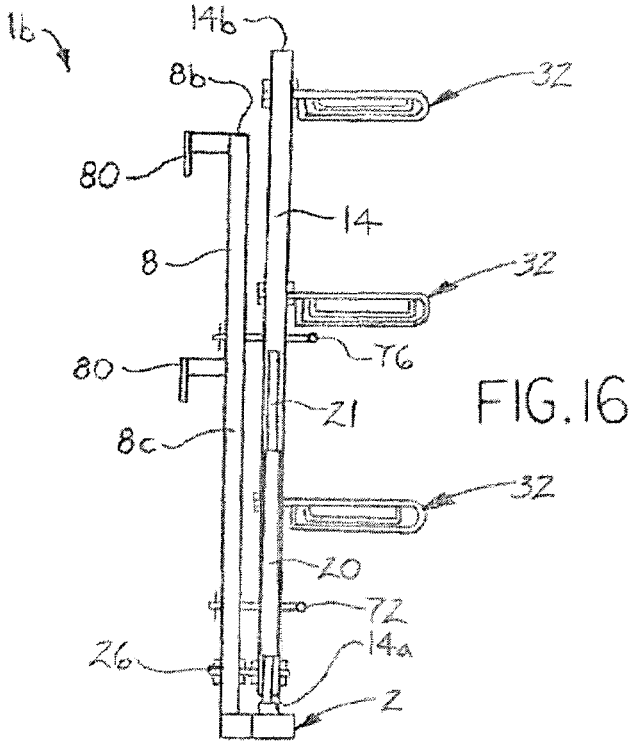
FIG. 16 is a side view of the saddle lift apparatus illustrated in FIG. 15, with multiple saddle supports of the apparatus illustrated in a raised, generally vertical storage position.

Referring next to FIGS. 15 and 16, an alternative illustrative embodiment of the saddle lift apparatus is generally indicated by reference numeral 1*a*. A first pivot release pin opening 70 extends through the saddle support arm 14 in spaced-apart relationship with respect to the pivot shaft 26. A second pivot release pin opening 71 extends through the arm support member 8. The first pivot release pin opening 70 registers with the second pivot release pin opening 71 when the saddle support arm 14 is disposed in the raised, vertical, supporting position illustrated in FIG. 16. When the saddle support arm 14 is disposed in the supporting position, a pivot release pin 72 is extended through the registering first and second pivot release pin openings 70 and 71, respectively, as illustrated in FIG. 16. A first lock pin opening 74 extends through the saddle support arm 14 in spaced-apart relationship with respect to the first pivot release pin opening 70. A second lock pin opening 75 extends through the arm support member 8 when the saddle support arm 14 is disposed in the raised, vertical, supporting position illustrated in FIG. 16. When the saddle support arm 14 is disposed in the supporting position, a lock pin 76 is extended through the registering first and second lock pin openings 74 and 75, respectively, as illustrated in FIG. 16. At least one mount element 80 may be provided on the arm support member 8 for attachment to a suitable support (not illustrated).

In typical use of the saddle lift apparatus 1*a*, the saddle support arm 14 is initially disposed in the lowered, loading/unloading position illustrated in FIG. 15 to facilitate placement of horse saddles 50 (shown in phantom in FIG. 8) on the respective saddle supports 32. The saddle support arm 14 is then raised to the storage position illustrated in FIG. 16 to store the saddles 50, typically by extending the piston 21 from the cylinder 20. When it is desired to lower the arm support member 8 from the storage position to the loading/unloading position, the pivot release pin 72 is removed from the first pivot release pin opening 70 and the second pivot release pin opening 71. The lock pin 76 is removed from the first and second lock pin openings 74 and 75, respectively. This enables the arm support member 8 to fall from the storage position of FIG. 16 to the loading/unloading position of FIG. 15 by gravity as the saddle support arm 14 pivots with respect to the pivot shaft 26 and the piston 21 passively extends back into the cylinder 20.

While the preferred embodiments of the invention have been described above, it will be recognized and understood that various modifications can be made in the invention and the appended claims are intended to cover all such modifications which may fall within the spirit and scope of the invention.

What is claimed is:

1. A saddle lift apparatus, comprising:

a base;

an arm support member extending from said base;

a saddle support arm pivotally carried by said arm support member;

a saddle lift actuating assembly engaging said saddle support arm, wherein said saddle lift actuating assembly comprises a cylinder pivotally carried by said base and a piston extendable from said cylinder and pivotally attached to said saddle support arm; and a plurality of saddle supports carried by said saddle support arm.

2. The saddle lift apparatus of claim 1 wherein said base comprises a main base member and a base extension member extending from said main base member and disposed in generally perpendicular relationship with respect to said main base member.

3. The saddle lift apparatus of claim 1 further comprising a reinforcing member extending between said base and said arm support member.

4. The saddle lift apparatus of claim 1 wherein each of said plurality of saddle supports is rotatably carried by said saddle support arm.

5. The saddle lift apparatus of claim 1 wherein each of said plurality of saddle supports comprises a saddle support frame carried by said saddle support arm and a pair of side support members carried by said saddle support frame.

6. The saddle lift apparatus of claim 5 wherein said saddle support frame comprises a saddle support shaft rotatably carried by said saddle support arm, a bend segment extending from said saddle support shaft and a return segment extending from said bend segment in generally parallel, spaced-apart relationship with respect to said saddle support shaft.

7. The saddle lift apparatus of claim 6 wherein said pair of side support members each comprises a pair of spaced-apart support member arms extending from said saddle support shaft and a connecting member extending between said support member arms.

8. A saddle lift apparatus, comprising:

a base;

an elongated arm support member extending from said base and having a proximal end, a distal end spaced-apart from said proximal end and a midpoint between said proximal end and said distal end;

a saddle support arm pivotally carried by said arm support member between said proximal end and said midpoint;

a saddle lift actuating assembly carried by said base and engaging said saddle support arm; and a plurality of saddle supports carried by said saddle support arm, wherein said saddle lift actuating assembly comprises a cylinder pivotally carried by said base and a piston extendable from said cylinder and pivotally attached to said saddle support arm.

9. The saddle lift apparatus of claim 8 wherein said base comprises a main base member and a base extension member extending from said main base member and disposed in generally perpendicular relationship with respect to said main base member.

10. The saddle lift apparatus of claim 8 further comprising a reinforcing member extending between said base and said arm support member.

11. The saddle lift apparatus of claim 8 wherein each of said plurality of saddle supports is rotatably carried by said saddle support arm.

12. The saddle lift apparatus of claim 8 wherein each of said plurality of saddle supports comprises a saddle support frame carried by said saddle support arm and a pair of side support members carried by said saddle support frame.

13. The saddle lift apparatus of claim 12 wherein said saddle support frame comprises a saddle support shaft rotatably carried by said saddle support arm, a bend segment extending from said saddle support shaft and a return segment extending from said bend segment in generally parallel, spaced-apart relationship with respect to said saddle support shaft.

14. The saddle lift apparatus of claim 13 wherein said pair of side support members each comprises a pair of spaced-apart support member arms extending from said saddle support shaft and a connecting member extending between said support member arms.

15. A saddle lift apparatus, comprising:

a support structure having a support panel and a pair of side support members extending from said support panel;

a base comprising a main base member and a base extension member extending from said main base member and disposed in generally perpendicular relationship with respect to said main base member;

an arm support member extending from said base and attached to said support panel of said support structure;

a saddle support arm pivotally carried by said arm support member;

a saddle lift actuating assembly engaging said saddle support arm, wherein said saddle lift actuating assembly comprises a cylinder pivotally carried by said base extension member of said base and a piston extendable from said cylinder and pivotally attached to said saddle support arm; and a plurality of saddle supports carried by said saddle support arm.

16. The saddle lift apparatus of claim 15 wherein each of said plurality of saddle supports comprises a saddle support frame having an elongated saddle support shaft rotatably carried by said saddle support arm, a bend segment extending from said saddle support shaft and a return segment extending from said bend segment in generally parallel relationship with respect to said saddle support shaft; and a pair of side support members each having a pair of spaced-apart support member arms extending from said saddle support frame and an elongated connecting member extending between said support member arms.

* * * * *